US007594825B2

(12) United States Patent
Bielesch et al.

(10) Patent No.: US 7,594,825 B2
(45) Date of Patent: Sep. 29, 2009

(54) DEVICE FOR CONNECTING AN ELECTRIC DRIVE TO AT LEAST ONE SUPPLY NETWORK, AND METHOD FOR THE PRODUCTION OF SUCH A CONNECTING DEVICE

(75) Inventors: Thomas Bielesch, Mühlacker (DE); Michael J. Stütz, Radolfzell (DE)

(73) Assignees: Behr GmbH & Co. KG, Stuttgart (DE); TRW Automotive Electronics and Components GmbH & Co. KG, Radolfzell (DE)

( * ) Notice: Subject to any disclaimer, the term of this patent is extended or adjusted under 35 U.S.C. 154(b) by 98 days.

(21) Appl. No.: 11/579,026

(22) PCT Filed: Apr. 28, 2005

(86) PCT No.: PCT/EP2005/004587

§ 371 (c)(1),
(2), (4) Date: Aug. 23, 2007

(87) PCT Pub. No.: WO2005/107023

PCT Pub. Date: Nov. 10, 2005

(65) Prior Publication Data

US 2008/0064245 A1 Mar. 13, 2008

(30) Foreign Application Priority Data

Apr. 28, 2004 (DE) ..... 10 2004 020 832

(51) Int. Cl.
*H01R 11/00* (2006.01)

(52) U.S. Cl. ..... 439/502

(58) Field of Classification Search ..... 439/225, 439/650–655, 721, 723, 724, 502
See application file for complete search history.

(56) References Cited

U.S. PATENT DOCUMENTS 3,550,063 A * 12/1970 Lecocq ..... 439/712
3,848,224 A * 11/1974 Olivero ..... 439/721
4,037,912 A * 7/1977 Besser et al. ..... 439/724
RE31,033 E * 9/1982 Wilson et al. ..... 439/654

(Continued)

FOREIGN PATENT DOCUMENTS

DE 199 17 352 A1 10/2000

(Continued)

*Primary Examiner*—Ross N Gushi
(74) *Attorney, Agent, or Firm*—Greer, Burns & Crain, Ltd.

(57) ABSTRACT

A device for connecting an electric drive to at least one supply network as well as several methods for producing such a connecting device includes a first contact/terminal unit to which at least one first wire of the supply network can be connected, a second contact/terminal unit to which the electric drive can be connected, and a third contact/terminal unit to which second wire of the at least one supply network can be connected. The first contact/terminal unit is connected to the second contact/terminal unit in such a way that a wire connection can be created between the at least one supply network and the electric drive. The third contact/terminal unit is connected to the first contact/terminal unit or the second contact/terminal unit such that a direct or indirect wire connection can be created between the at least one second wire and the at least one supply network.

16 Claims, 9 Drawing Sheets

U.S. PATENT DOCUMENTS

| | | | | |
|---|---|---|---|---|
| 4,740,167 | A * | 4/1988 | Millhimes et al. | 439/92 |
| 5,322,445 | A * | 6/1994 | Ozaki et al. | 439/212 |
| 5,605,465 | A * | 2/1997 | Kobayashi et al. | 439/76.2 |
| 5,911,600 | A * | 6/1999 | Mosquera | 439/655 |
| 6,030,241 | A * | 2/2000 | Chiba | 439/222 |
| 6,390,830 | B1 * | 5/2002 | Onizuka | 439/76.2 |
| 6,394,857 | B1 * | 5/2002 | Crochet | 439/721 |
| 6,661,672 | B2 * | 12/2003 | Ito | 361/752 |
| 7,192,289 | B2 * | 3/2007 | Kowalski | 439/106 |
| 2001/0010985 | A1 * | 8/2001 | Kasai | 439/638 |

FOREIGN PATENT DOCUMENTS

| | | | |
|---|---|---|---|
| DE | 100 63 926 | A1 | 7/2002 |
| DE | 101 19 178 | A1 | 10/2002 |
| EP | 1 058 170 | A | 12/2000 |

* cited by examiner

DEVICE FOR CONNECTING AN ELECTRIC DRIVE TO AT LEAST ONE SUPPLY NETWORK, AND METHOD FOR THE PRODUCTION OF SUCH A CONNECTING DEVICE

BACKGROUND

The present invention relates to a device for connecting an electric drive to at least one supply network, and to a plurality of methods for manufacturing such a device.

A plugging or plug system for connecting an (electric) drive of an electric fan to an electrical system of the motor vehicle is known in the prior art. Examples include a cooling system for cooling the engine of a motor vehicle or an air-conditioning system for cooling the passenger compartment of a motor vehicle.

FIG. 7 shows such a plug system 780 or 781 from the prior art for a double-fan system 700 of a motor vehicle cooling module.

In this double-fan system 700, two electric drive units or motors 710, 711 are connected to an electrical system 770 of a motor vehicle. The connection is made using the prior art plug system 780, 781 which is a four-pole plug connection that can be contacted at one side.

Plug system 780, 781 comprises two plug parts, each of which is contactable at one side or pluggable into one another. A three-pole or a four-pole electrical system plug connector 730 or 731, that is contactable at one side is also included. Additionally, an appurtenant three-pole or, as shown as an example, a four-pole mating connector 720 or 721, is also contactable at one side.

Electrical system plug connector 730 or 731 is connected to the electrical system 770 via a cable 740 or 741. Mating connector 720 or 721 is integrated into an electric drive motor 710 or 711, whereby the electric drive motor 710 or 711 is connected to the mating connector 720 or 721 corresponding to the cable 740 or 741 or a connection of this sort.

In the case shown, the cable 740 or 741 bundles four lines or wires, two lines being used for the main power supply which, in this case, are (+/−) lines from a battery power supply. The remaining two lines are the control and bus lines of a vehicle electronics system. For the driving of each respective drive, the corresponding holds for the integrated connection are between the mating connector 720 or 721 and the respective drive motor 710 or 711.

Given a contacted plugging system 780 or 781, or plug parts 730 or 731 and 720 or 721 that are plugged into one another, the connection between the vehicle electrical system and the (respective) drive 710 or 711 is created via four pole contacts 750 to 753 or 760 to 763, and the drive 710 or 711 is supplied via this connection with energy, as well as with control and communication signals.

Each respective drive shaft 790 or 791 is set into rotation and energy is transferred to a fan or blower.

This double fan system 700, having two drive units 710 and 711 connected to the vehicle electrical system 770 via respective one-sided contactable plug connections 780 or 781, has the disadvantage that each drive unit 710 or 711 separately contacts the electrical system 770. This requires an increased cabling expense and/or assembly expense.

Many fan drives are controlled by expensive interfaces and require a higher number of connection lines. In particular, control lines and/or bus systems, are required for each fan drive. Therefore, the associated cabling expense for the fan system as a whole is correspondingly increased.

In addition, in more expensive fan drives having additional control lines and increased cabling expense, further measures are required to decouple the individual fan drives or fan systems with respect to communication and being able to control them individually. There are also further disadvantages with regard to diagnostic capability.

Disadvantages are found in simple fan systems, and to a greater degree, in more expensive multiple fan systems in which a multiplicity of fans or fan drives must each be contacted separately to a vehicle electrical system by means of the plug connection that is contactable at one side.

The present invention is therefore based on the object of creating a plug system, and more specifically, to a connecting or terminal device for connecting an electric drive or an actuator to a supply network or to a cabling system where the connecting device is configured for a simple and economical cabling.

In addition, a modular construction, made up of a plurality of fan systems and actuators, is to be enabled.

Moreover, the present invention is intended to make it possible to avoid the above further disadvantages in more expensive fan systems, in particular in multiple-fan systems.

SUMMARY

The device according to the present invention for connecting an electric drive to at least one supply network has a first contact/terminal unit to which at least one first line of the at least one supply network is connected.

In the following, a contact or terminal unit is understood to be a functional element of a contacting, for example, a plug contact element having one or more contact point, such as a plug contact side of a one-sided contactable plug having pole contacts at this side.

Furthermore, in the following disclosure, a line is understood to be any type of signal and/or data line, and a supply network is understood to be a contiguous higher-order unit of such lines.

Additionally, a connecting is understood to refer to (functional) contacting.

The device according to the present invention also has a second contact/terminal unit to which the electric drive can be connected.

It is preferable to integrate the second contact/terminal unit into the electric drive, for example an electric motor.

In addition, the device according to the present invention has a third contact/terminal unit for connecting at least one second line of the at least one supply network.

Thus, at least one second line can preferably be connected to another electric drive, for example, in the context of a double-drive system such as a double fan.

In the device according to the present invention, the first contact/terminal unit is connected to the second contact/terminal unit in such a way that a line or wire connection is able to be created between the at least one supply network and the electric drive.

Therefore, the electric drive is connected to the at least one supply network via the first and the second contact/terminal unit.

The third contact/terminal unit is connected to the first contact/terminal unit or to the second contact/terminal unit in such a way that a direct or an indirect line connection is created between the at least one second line and the at least one supply network.

Further, the connection of the third contact/terminal unit to the first contact/terminal unit realizes a direct connection between the at least one second line and the at least one first line or the at least one supply network.

In the case of the connection of the third contact/terminal unit to the second contact/terminal unit, an indirect connection is realized between the at least one second line and the at least one first line or the at least one supply network. In this case, a direct connection is created between the at least one first line or the at least one supply network and the electric drive. A direct connection is also created between the at least one second line and the electric drive.

If the at least one second line (at the other side) is connected to another drive, such as in a double-drive system, the drives are connected in parallel to the at least one supply network (directly in the first case above or indirectly in the second case above).

Additionally, the device according to the present invention realizes a two-sided contactable plug (double plug) having a first, main plug connection to a supply network such as a vehicle electrical system, and a second, additional plug connection to which the at least one second line (as well as possible subsystems connected thereto) is (are) connected.

In addition, this two-sided contactable (double) plug is connected to the drive via a third contacting that is integrated in the electric drive.

Via the third, integrated contacting in connection with the first main plug connection, the electric drive can be connected to the supply network.

Via the second additional connecting plug or the at least one second line, additional subsystems, such as additional electric drive systems or actuators can be connected in direct or indirect connection to or via the main plug connection.

In this way, multiple-fan systems can be realized in which a multiplicity of fans are each connected to the at least one supply network in parallel, indirectly or directly, by the two-sided contactable plug, or by the double plug according to the present invention.

In a preferred embodiment of the device according to the present invention, a plurality of first lines are connected to the first contact/terminal unit and/or a plurality of second lines are connected to the second contact/terminal unit.

Given the connection of a plurality of lines and multiple-pole, in particular two-pole, three-pole, or four-pole contact systems or plug systems/plug connections can be realized.

Current or voltage supply lines, data or communication lines, control/control signal lines, and/or lines of bus systems can also be provided.

In the corresponding cases of lines, the at least one supply network is a power supply network and/or a communication network, and in particular a bus system and/or a control network.

The respective lines or supply networks can be components of a vehicle electrical system, in particular a motor vehicle electrical system, or a vehicle electronics system.

In addition, the first, second, or third contact/terminal unit can be fashioned as a plug contact unit having at least one plug contact.

Such a plug contact unit, or the first, second, or third contact/terminal unit, can be set up in order to receive a contact plug.

In a preferred embodiment, it is provided to install the device in a cooling system for engine cooling and/or in an air-conditioning system for cooling the passenger compartment of a motor vehicle.

In this case as well as in cases of the connection of a multiplicity of drives or actuators in the double-drive systems, the electric drive can be an electric motor of an electric fan. Additionally, the actuator can for example be an expanding-material element.

In the method according to the present invention for manufacturing the present electric drive, a metallic flat conductor is divided along a predeterminable dividing line in a predeterminable area at a first end of the metallic flat conductor.

Preferably, this dividing can take place through mechanical processing of the flat conductor, for example through a slitting or cutting of the metallic flat conductor in this area.

In addition, the metallic flat conductor can preferably be divided along its longitudinal direction in the predeterminable area, i.e., the predeterminable dividing line is the longitudinal direction of the metallic flat conductor.

According to the present invention, the dividing forms a first longitudinal segment of the metallic flat conductor having a first free end and a second longitudinal segment of the metallic flat conductor having a second free end.

Preferably, at least one of the two longitudinal segments is bent around an angle of approximately 90°. Accordingly, a more economical and simpler angled plug connector can be realized.

In a particularly preferred specific embodiment, both longitudinal segments are bent in opposite directions, each by an angle of approximately 90°. In this case, the two longitudinal segments form an angle of approximately 180° to one another, i.e., the two longitudinal segments are situated at least approximately in one plane.

In addition, according to the present invention, the first contact/terminal unit is set up at the first free end, and the second contact/terminal unit is set up at the second free end.

In this configuration, a double contact can be realized, for example, a first contact for a main connecting plug and a second contact for an additional connecting plug.

At the other end, a second end of the metallic flat conductor, the second contact/terminal unit, for example, the connection for the electric drive, is set up.

In another preferred construction, the metallic flat conductor is made of a copper based metal.

In order to protect the metallic flat conductor, the conductor can be extrusion-coated, and jacketed or sheathed with plastic, at least in the area of its formed ends, i.e. at the first and/or at the second free end of the longitudinal segments and/or at the second end of the metallic flat conductor.

A sheath or extrusion-coating applied to the metallic flat conductor in part or in its entirety may also be provided.

In these ways, simple and economical plastic plug connections can be manufactured, including a bent-off shape in the case of only one bent-off longitudinal segment or a straight shape in the case of two, i.e. both, longitudinal segments bent off in opposite directions.

In another specific embodiment, it is provided to fashion a contact/terminal unit as a contact jack or sleeve, female contact. This can be realized in such a way that a contact jack is attached to the respective end of the metallic flat conductor, for example, by welding.

If such contact jacks are attached at all ends of the metallic flat conductor, a multi-contact plug unit can be realized in this way.

In another, particularly preferred, specific embodiment, the metallic flat conductor is integrated into a distribution apparatus of air guides, and a plug unit is molded on.

With the device according to the present invention, as well as developments thereof, including a plug system having two integrated and multipolar plugs (double plug), the following can be realized, possibly simultaneously depending on the construction:

A main connecting plug to an electrical system of a vehicle having corresponding main power supply lines and control or bus lines.

A second, additional connecting plug, to additional drive units or subsystems, such as actuators, can be realized having corresponding main power lines, control lines, and bus lines.

Internal connections of the two plugs named above, i.e. the main connecting plug and the second connecting plug, as well as of the drive with regard to main power supply lines, for example (+/−) terminals of a battery voltage supply, can be realized.

A supplying or, depending on the design, a connecting of the two above plugs, as well as of the drive, to corresponding control and bus lines of a vehicle electronics system can be realized.

The main connecting plug can be used as a main control input for the first electric drive and for additional drives, or drive units or actuators. The second connecting plug can be used as an additional bus system for controlling and communicating with the additional drive units or actuators. In this case, a master-slave operation of the drives can be realized.

The plug connections of control lines and bus lines can be designed as bidirectional inputs and/or outputs. These can then be used as sensor inputs or as bus or control lines for external components such as a louver or an expanding-material element.

The control or bus lines can be used for coding for the respective drive (e.g., right/left drive). An intelligent integration into a fail-safe design for the fan system (louver) can also be realized.

Further, a connection of additional drives to a multi-wire additional line can be realized.

In addition to the advantages described above, the device according to the present invention, as well as its developments, also has the following further advantages:

A plug for connecting drive systems to a vehicle electrical system that supplies the drive systems with battery voltage and with control lines can be economically realized.

In a minimal case example, two drives can be operated using only one control line.

All standard bus systems of various manufacturers or customers can be implemented by a plug system according to the device of the present invention. Such examples include a PWM interface both with and without terminal 15/87 controlling, a CAN bus, or a LIN bus system.

Further, two PWM input signals, two drives, for example for two fans, can be controlled separately with only one plug having at least four poles according to the device of the present invention.

In particular, the device according to the present invention, as well as its developments, makes it possible to reduce cabling expense, for example in a vehicle electronics system.

The manufacturing method according to the present invention, as well as its developments, also enables an economical manufacture of the device according to the present invention, and in particular, a plug system according to the present invention.

Given corresponding design and software modification, the present invention enables drive systems to communicate directly with one another or with the on-board system (vehicle electronics system).

A second plug connector according to the present invention, for example a connector to a second drive unit, can, as needed, also be used only in one-sided fashion (for connecting to the first plug connector according to the present invention, which is used in double-sided fashion to connect to the first drive unit). Here, the second plug side can be sealed with plastic or covered with a dummy plug.

In addition, thermal management of a module and of a fan system can be taken over by means of the present invention through integration of a software unit into the drives.

Contacts of the input or main plug connector, in comparison with contacts of the output or additional plug connector, can be placed at different drive inputs or drive outputs, so that these can be controlled or read independently of one another.

In addition, the present invention makes it possible to integrate protective systems, such as a blocking protection, a fail-safe mode, and/or a diagnostic system, into the drive.

Additional advantages, features, and possible uses of the present invention result from the following description of exemplary embodiments, in connection with the Figures.

DETAILED DESCRIPTION

A first embodiment of the present invention, having a straight plug connector contactable at two sides, is described with reference to FIGS. 1 and 5.

Figure 1:
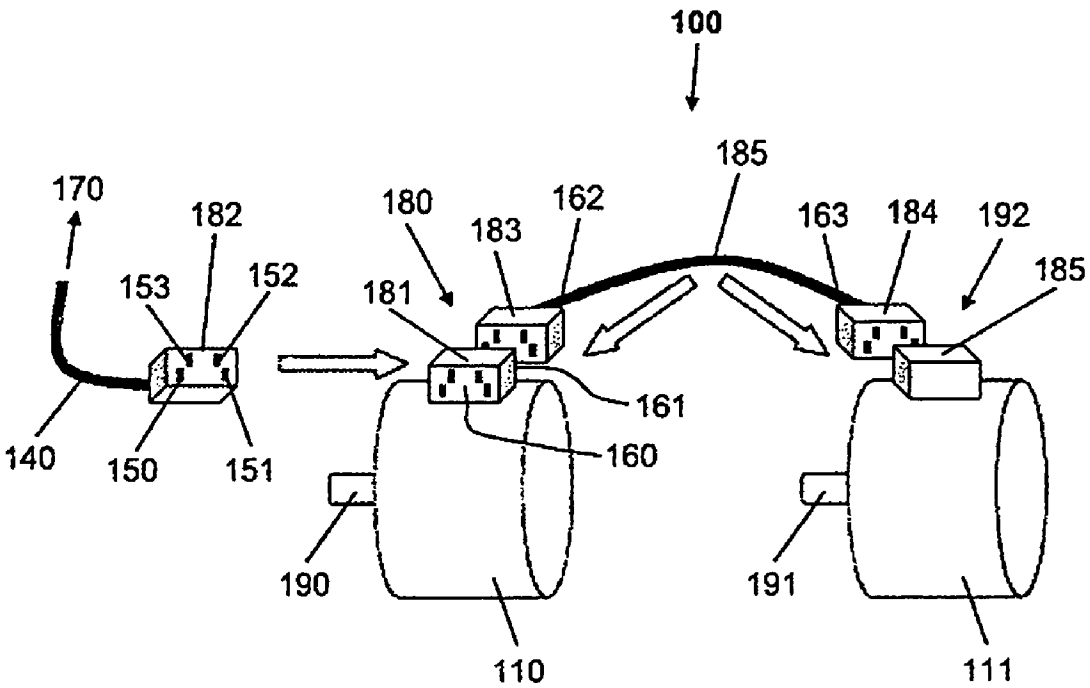
FIG. 1 shows a drawing of a double-fan system having straight plug connections contactable at two sides, according to a first exemplary embodiment of the present invention.

FIG. 1 shows a drawing of a double-fan system 100 for use in a motor vehicle cooling module having a straight plug connector 180 that is contactable at two sides.

Figure 5:
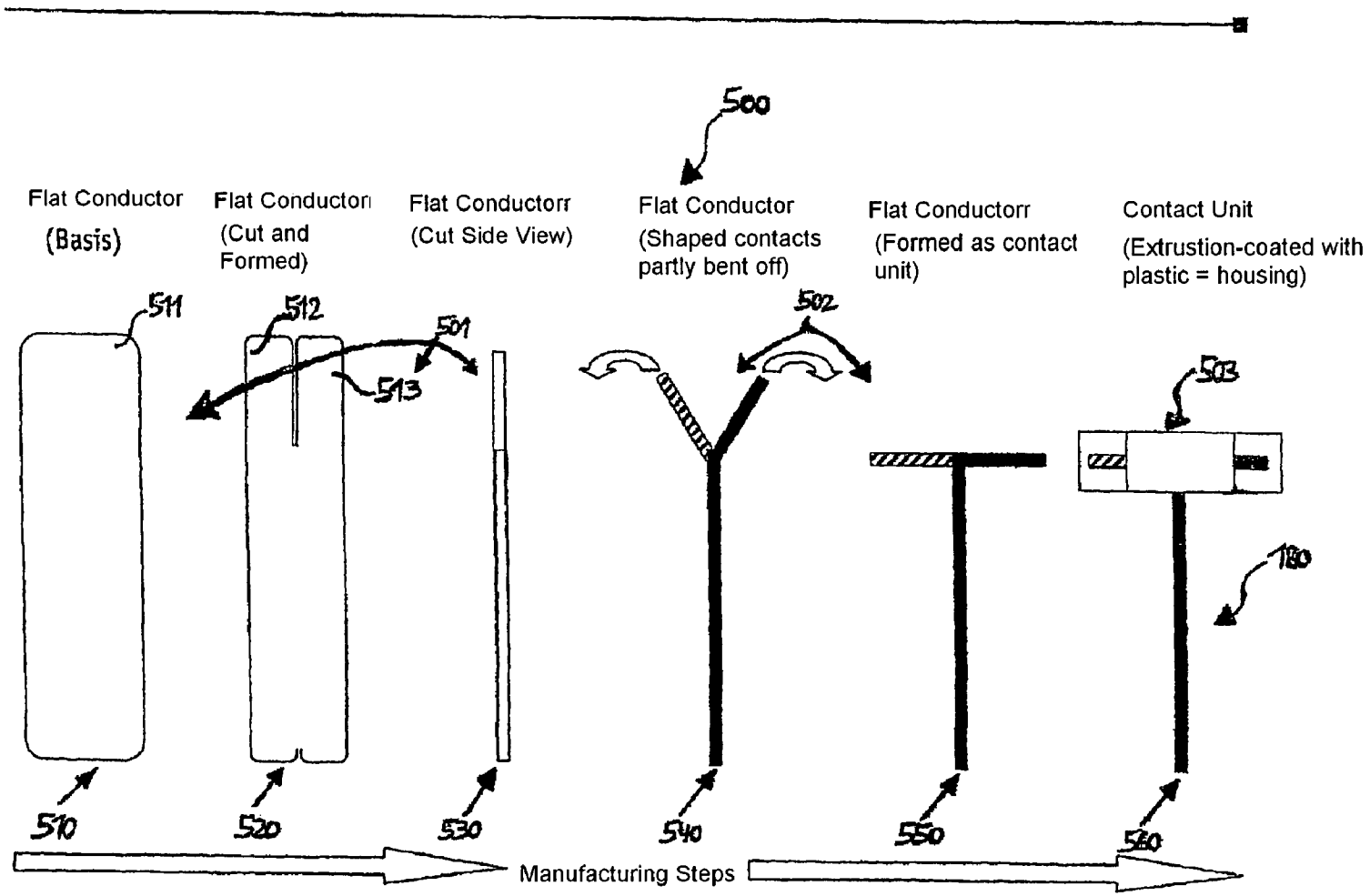
FIG. 5 shows a drawing having manufacturing steps of a manufacturing method according to the present invention for manufacturing a straight plug, contactable at two sides, for a plug connector in the double-fan system according to the first exemplary embodiment of the present invention.

FIG. 5 shows a drawing having manufacturing steps 501 to 503, illustrated by drawings 510 to 560, of a manufacturing method 500 according to the present invention for manufacturing a straight plug 181 contactable at two sides for a plug connection 180 in double-fan system 100 according to FIG. 1.

In the double fan system 100 shown in FIG. 1, two electric drive units or motors and a plurality of electric drives including a first electric drive 110 and a second drive or an additional electric drive 111 are connected to an electrical system or a supply network 170 of a motor vehicle. The connection is made using the two-sided contactable straight four-pole plugs or plug connections 180 for the first drive 110 and a one-sided contactable four-pole plug or plug connection 192 for the second drive 111.

The two-sided contactable straight four-pole plug or plug connection 180 comprises, as a central element, a two-sided contactable multipolar plug or a second contact unit 181 (double plug) that is integrated into the first drive 110.

In addition, the two-sided contactable plug connection 180 comprises a four-pole one-sided contactable electrical system plug or a first contact unit 182 that is connected at one side to the electrical system 170 via a cable 140.

The cable 140 bundles four lines, two of which are used for the main power supply, in this case (+/−) lines of a battery power supply. The remaining two lines are control and bus lines of a vehicle electronics system.

At the other side, electrical system plug 182 can be plugged to a first contact side 160 of the two-sided contactable four-pole plug 181.

The connection between the vehicle electrical system and the two-sided contactable plug 181 is created by a plugged contact between the electrical system plug 182 and the two-sided contactable straight plug 181 via four pole contacts 150 to 153.

Because this plug 181 is also connected to the first drive 110 via the integrated connection, the first drive 110 is thereby connected to the electrical system 170, and is supplied via this connection with energy and with communication and control signals.

Accordingly, the drive shaft 190 is set into rotation and energy is transferred to a fan or blower.

In addition, the two-sided contactable straight plug connection 180 has a first one-sided contactable four-pole connecting plug or a third contact unit 183 that is connected to a connecting cable or at least one second line 185 at the one end 162 thereof.

The connecting cable 185 is constructed in a manner corresponding to (electrical system) a cable or the at least one first line 140, and likewise, bundles the four lines.

At the other end 163 of the connecting cable 185, a second one-sided contactable four-pole plug connector 184 is situated.

The first plug connector 183 is preferably plugged at a second contact side 161 of the two-sided contactable plug 181.

Because the first contact side 160 and the second contact side 161 of the two-sided contactable straight plug 181 are situated on opposite sides of the plug 181, what is known as a "straight" plug 181 results.

The one-sided contactable, four-pole plug or plug connection 192 is formed so that the second one-sided contactable plug 184 stands in plugged contact with another one-sided contactable plug 185 that is integrated into a second drive 111.

Alternatively, in addition to the one-sided contactable plug 185, a second two-sided contactable straight plug 181 may be used.

Via this one-sided contactable plug connection 192, connecting cable 185, and additionally via two-sided contactable plug connection 180, second drive 111 is also connected to electrical system 170, and is supplied via this connection with energy and with control and communication signals.

Correspondingly, a drive shaft 191 is set into rotation, and energy is transferred to the blower or the fan.

As shown in FIG. 5, the manufacture 500 of the two-sided contactable straight plug 181 for the plug connection 180 in the double-fan system 100 takes place according to the following steps 501 to 503:

In a first step 501, illustrated by drawings 510 to 530, a flat conductor piece 511 is cut to length and is correspondingly fashioned into a contact shape.

This results in two additional flat conductors or a first longitudinal segment 512 and a second longitudinal segment 513, which, in a second step 502 illustrated by 540 and 550, are bent off in opposite directions at right angles.

If one contact side is to be formed as a contact jack, this is to be realized through the additional attachment of a contact jack, e.g. by welding.

This is to be carried out in the same manner for all contacts, so that a complete multi-contact plug unit results.

In a third step 503, illustrated by 560, the processed flat conductor piece is formed as a contact unit, and is extrusion-coated with plastic to form a plug housing.

Alternatively, the flat conductors can be integrated as supply lines to the drives, into the distributor apparatus of the air guides, and to mold on the plug unit.

A second exemplary embodiment of the present invention having a two-sided contactable bent-off plug connection 280 is now described with reference to FIGS. 2 and 6.

Figure 2:
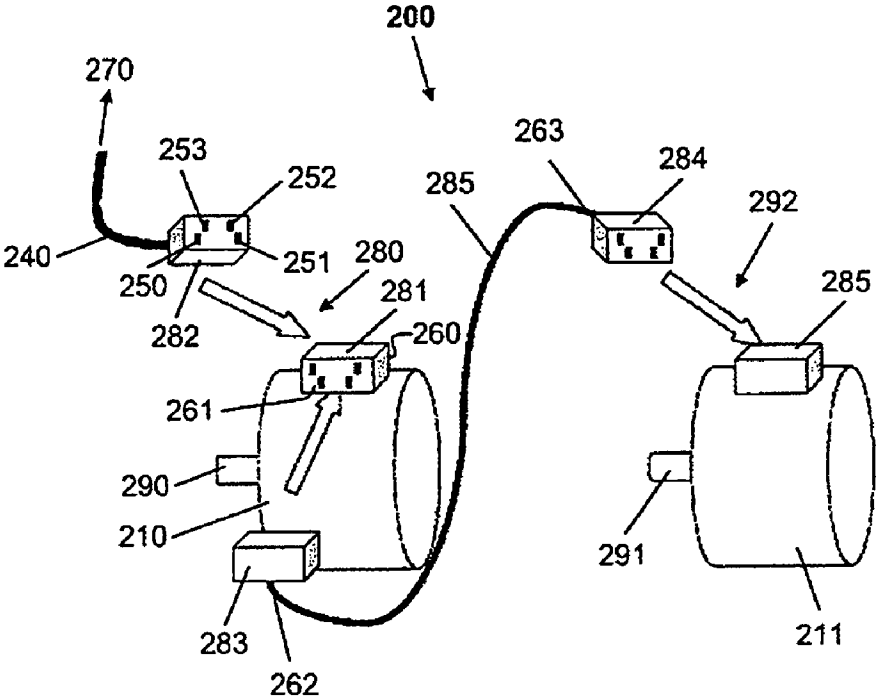
FIG. 2 shows a drawing of a double-fan system having bent-off plug connections contactable at two sides, according to a second exemplary embodiment of the present invention.

FIG. 2 shows a drawing of a double-fan system 200 capable of being used in a motor vehicle cooling module, and includes a two-sided contactable bent-off plug connector 280 according to the present invention.

Figure 6:
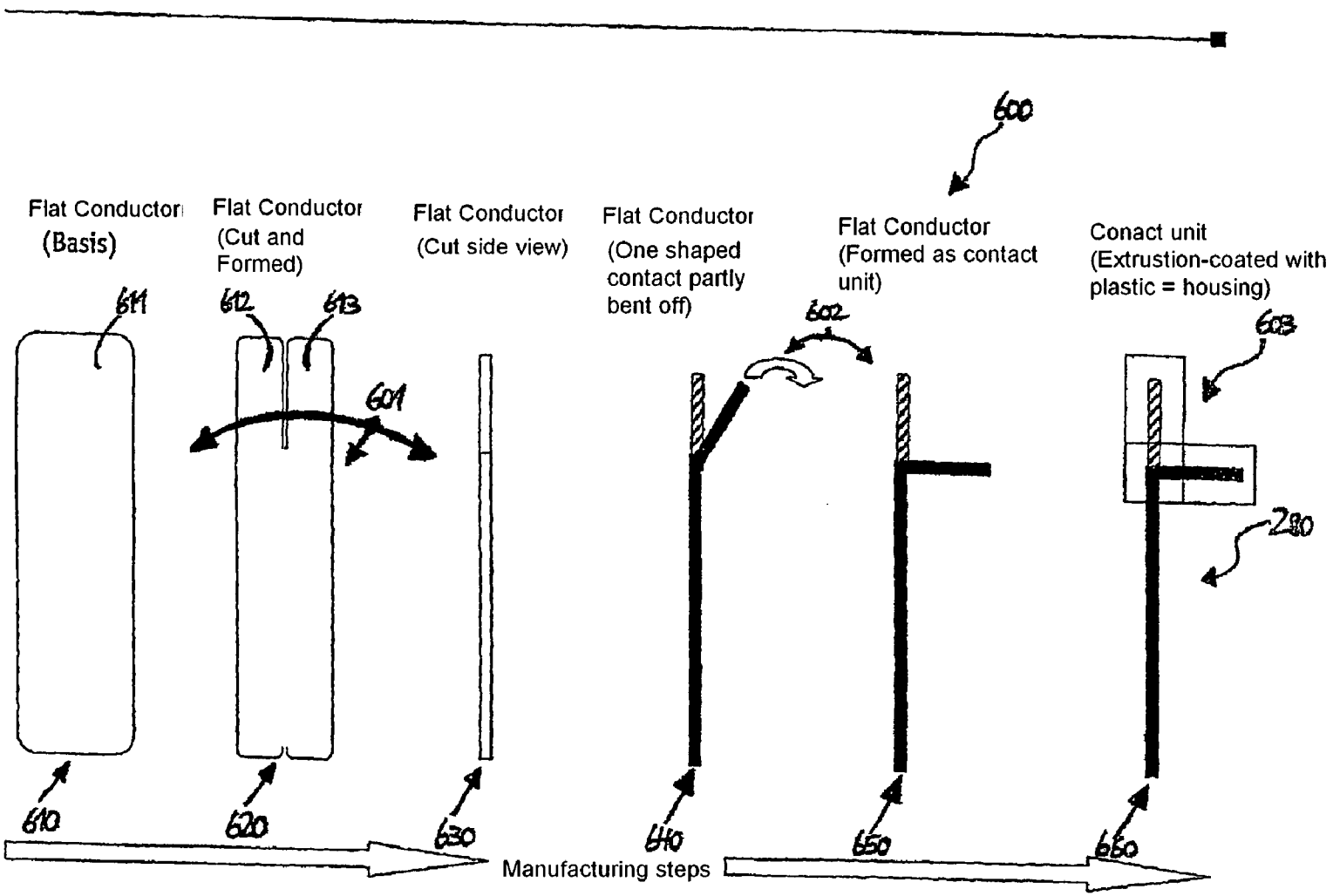
FIG. 6 shows a drawing having manufacturing steps of a manufacturing method according to the present invention for manufacturing a bent-off plug, contactable at two sides, for a plug connector in the double-fan system according to the second exemplary embodiment of the present invention.
Figure 7:
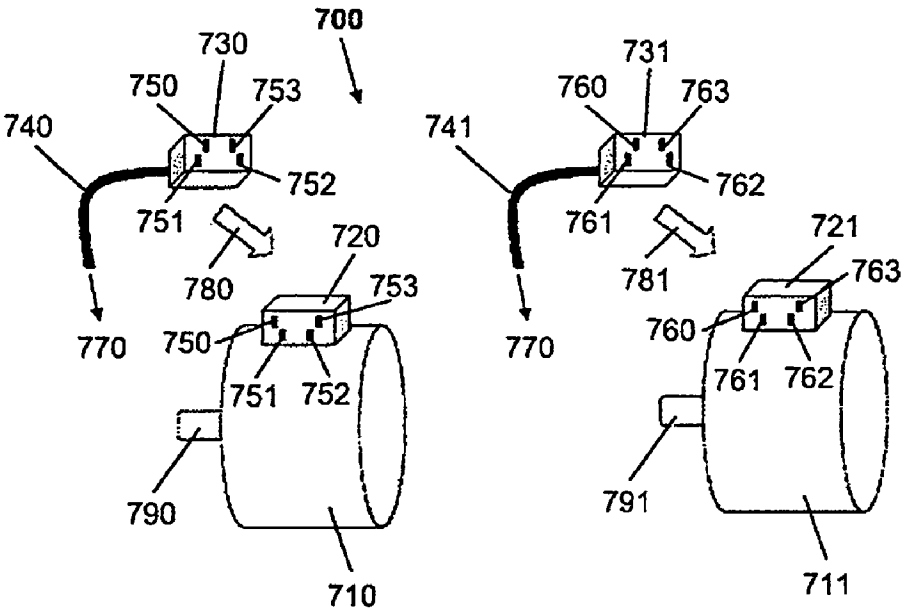
Prior Art Figure 7
FIG. 7 shows a drawing of a double-fan system having plug connections contactable at one side according to the prior art.

FIG. 6 shows a drawing having manufacturing steps 601 to 603, illustrated by drawings 610 to 660, of a manufacturing method 600 according to the present invention for manufacturing a two-sided contactable, bent-off plug or a second contact unit 281 for plug connection 280 in a double-fan system 200 according to FIG. 2.

In the double-fan system 200 in FIG. 2, two electric drive units or motors, as well as a first drive 210 and a second drive or an additional electric drive 211, are connected to an electrical system or at least one supply network 270 of a motor vehicle. The connections are made using two-sided contactable bent-off four-pole plugs or plug connections 280 for the first drive 210 and a one-sided contactable four-pole plug or plug connection 292 for the second drive 211.

Two-sided contactable, bent-off, four-pole plug or plug connection 280 comprises, as a central element, a two-sided contactable multipolar plug or the second contact unit 281 (double plug) that is integrated into the first drive 210.

In addition, the two-sided contactable plug connection 280 comprises a four-pole one-sided contactable electrical system plug or a first contact unit 282 that is connected to the electrical system 270 at one side via a cable or at least one first line 240.

The cable 240 bundles four lines, two lines of which are used for the main power supply. In this embodiment, the two lines are (+/−) lines of a battery power supply. The remaining two lines are control and bus lines of a vehicle electronics system.

At the other side, the electrical system plug 282 can be plugged to a first contact side 260 of the two-sided contactable four-pole plug 281.

The plugged contact between the electrical system plug 282 and the two-sided contactable bent-off plug 281 is created via the four pole contacts 250 to 253 and the connection between the electrical system and the two-sided contactable plug 281.

Because the plug 281 is additionally connected to the first drive 210 via the integrated connection, the first drive 210 is thereby connected to the electrical system 270 and is supplied with energy and with control and communication signals.

Correspondingly, a drive shaft 290 is set into rotation and energy is transferred to a blower or a fan.

In addition, the two-sided contactable bent-off plug connection 280 comprises a first one-sided contactable four-pole plug connector or a third contact unit 283 that is connected to a connecting cable or at least one second line 285 at one end 262 thereof.

Connecting cable 285 is constructed in the manner of (electrical system) the cable 240, and likewise bundles the four lines.

At the other end 263 of the connecting cable 285, there is a second one-sided contactable four-pole plug connector 284.

The first plug connector 283 is capable of being plugged to a second contact side 261 of the two-sided contactable plug 281.

Because the first contact side 260 and second contact side 261 of the two-sided contactable bent-off plug 281 are situated at sides of the plug 281 that are situated in normal fashion to one another, a "bent-off" plug 281 is formed.

The one-sided contactable four-pole plug or plug connection 292 is formed in the second one-sided contactable plug 284 that is in plugged contact with another one-sided contactable plug 285 that is integrated into the second drive 211.

Alternatively, the additional one-sided contactable plug 285, such as a second two-sided contactable bent-off (or also straight) plug 281, can be used.

Via the one-sided contactable plug connection 292, the connecting cable 285, in addition to the two-sided contactable plug connection 280, the second drive 211 is also connected to the vehicle electrical system 270, and is supplied via this connection with energy and with control and communication signals.

Correspondingly, a drive shaft 291 is set into rotation to transfer energy to a blower or a fan.

As is shown in FIG. 6, the manufacture 600 of the two-sided contactable bent-off plug 281 for the plug connection 280 in the double-fan system 200 takes place according to the following steps 601 to 603:

In a first step 601, illustrated by drawings 610 to 630, a flat conductor piece 611 is cut to length and is correspondingly formed to a contact shape.

Two additional flat conductors 612 and 613 result, of which one is bent off at a right angle in a second step 602, illustrated by 640 and 650.

If one contact side is to be constructed as a contact jack, this is to be realized through the additional attachment of a contact jack, for example, by welding.

This is to be carried out for all contacts in the same manner, so that a complete multi-contact plug unit results.

In a third step 603, illustrated by 660, the processed flat conductor piece, formed as a contact unit, is extrusion-sheathed with plastic to form a plug housing.

A third embodiment of the present invention, a sample switching diagram for a "direct" multiple-fan system having two-sided contactable plug connections, is now described with reference to FIG. 3.

Figure 3:
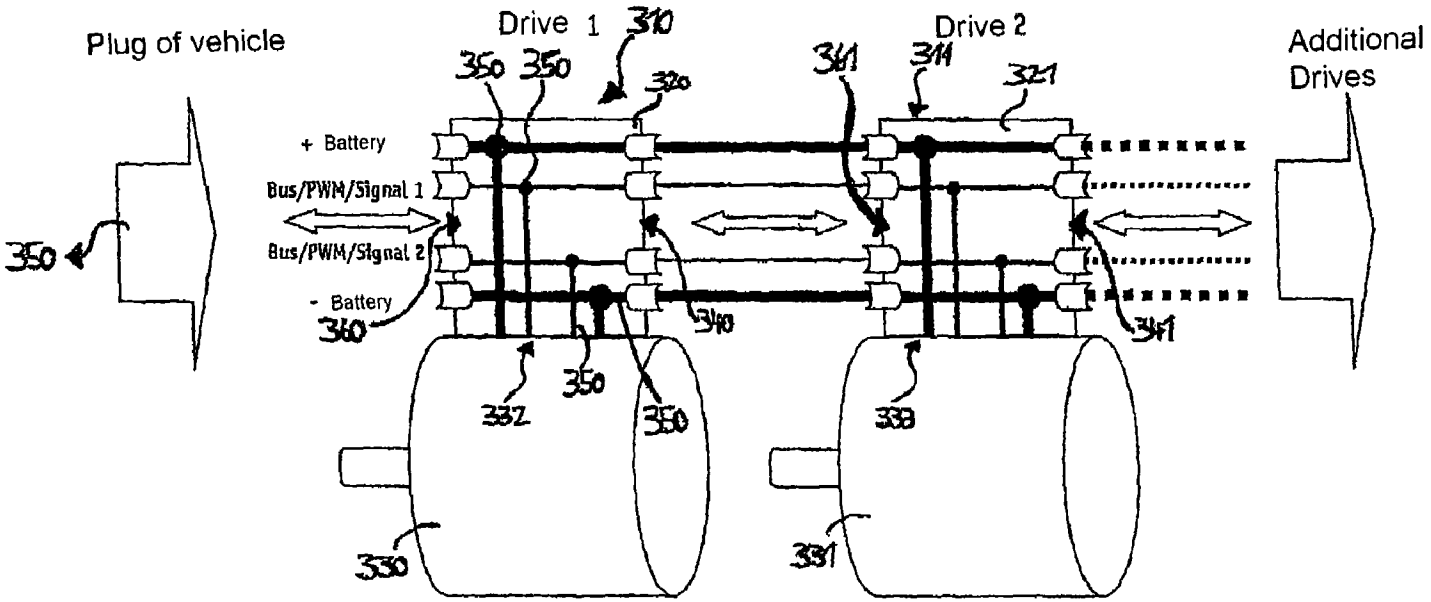
FIG. 3 shows a drawing of a sample switching diagram in a multiple-fan system having plug connections contactable at two sides, according to a third exemplary embodiment of the present invention.

FIG. 3 shows a drawing of the sample switching diagram in the multiple-fan system having two-sided contactable plug connections 310 and 311, electric drives 330 and 331 of the system, each being connected directly to an electrical system 350 of a motor vehicle using two-sided contactable plug connections 310 and 311 or two-sided contactable plugs (double plugs) 320 and 321.

The two-sided contactable plug 320 or 321 is wired in such a way that both the contacting 332 or 333 a drive 330 or 331, and the contacting 340 or 341 for forwarding via a corresponding line connecting node 350 is connected directly to terminal contacting 360 or 361.

A fourth embodiment of the present invention, a sample switching diagram of an "indirect" multiple-fan system having two-sided contactable plug connections, is now described with reference to FIG. 4.

Figure 4:
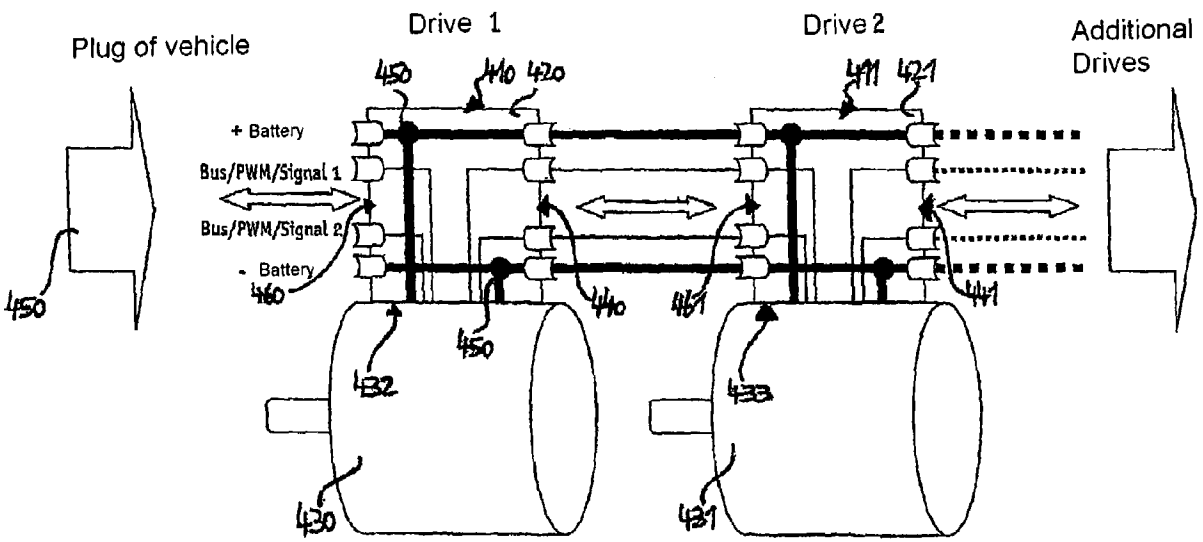
FIG. 4 shows a drawing of a sample switching diagram in a multiple-fan system having plug connections contactable at two sides, according to a fourth exemplary embodiment of the present invention.

FIG. 4 shows a drawing of the sample switching diagram in a multiple-fan system having two-sided contactable plug connections 410 and 411, electric drives 430 and 431 where each is connected indirectly to an electrical system 450 of a motor vehicle using two-sided contactable plug connections 410 and 411 or two-sided contactable plugs (double plugs) 420 and 421.

The two-sided contactable plug 420 or 421 is wired in such a way that the contacting 432 or 433 to the drive 430 or 431, as well as the contacting 440 or 441 for forwarding, is connected partly directly (for energy supply) via a corresponding line connecting node 450, and partly indirectly (for communication) to a terminal contacting 460 or 461.

A fifth embodiment of the present invention, a sample switching diagram for a double-fan system with an actuator connected having two-sided contactable plug connections, is now described with reference to FIG. 8.

Figure 8:
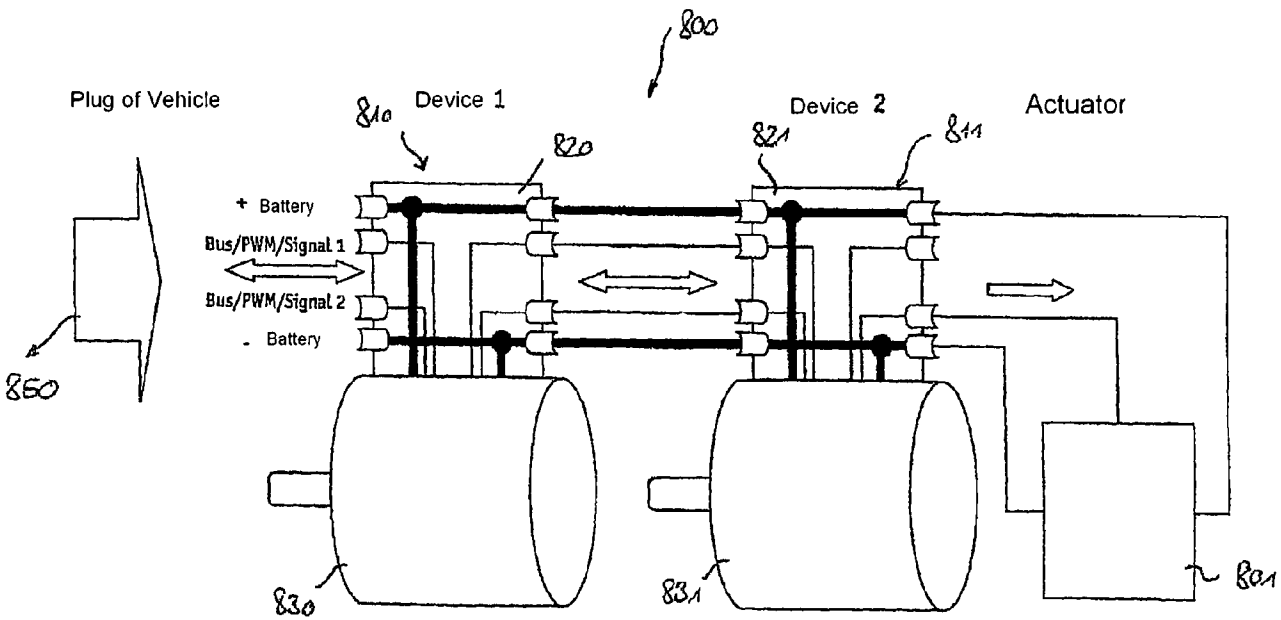
FIG. 8 shows a drawing of a sample switching diagram in a double-fan system having a connected actuator, having plug connections contactable at two sides, according to a fifth exemplary embodiment of the present invention.

FIG. 8 shows a drawing of sample switching diagram 800 in the multiple-fan system with the connected actuator, having two-sided contactable plug connections 810 and 811, electric drives 830 and 831 where each is connected indirectly to an electrical system 850 of a motor vehicle using two-sided contactable plug connections 810 and 811, or two-sided contactable plugs (double plugs) 820 and 821.

A sixth embodiment of the present invention, another sample switching diagram for a double-fan system with connected actuator having two-sided contactable plug connections, is now described with reference to FIG. 9.

Figure 9:
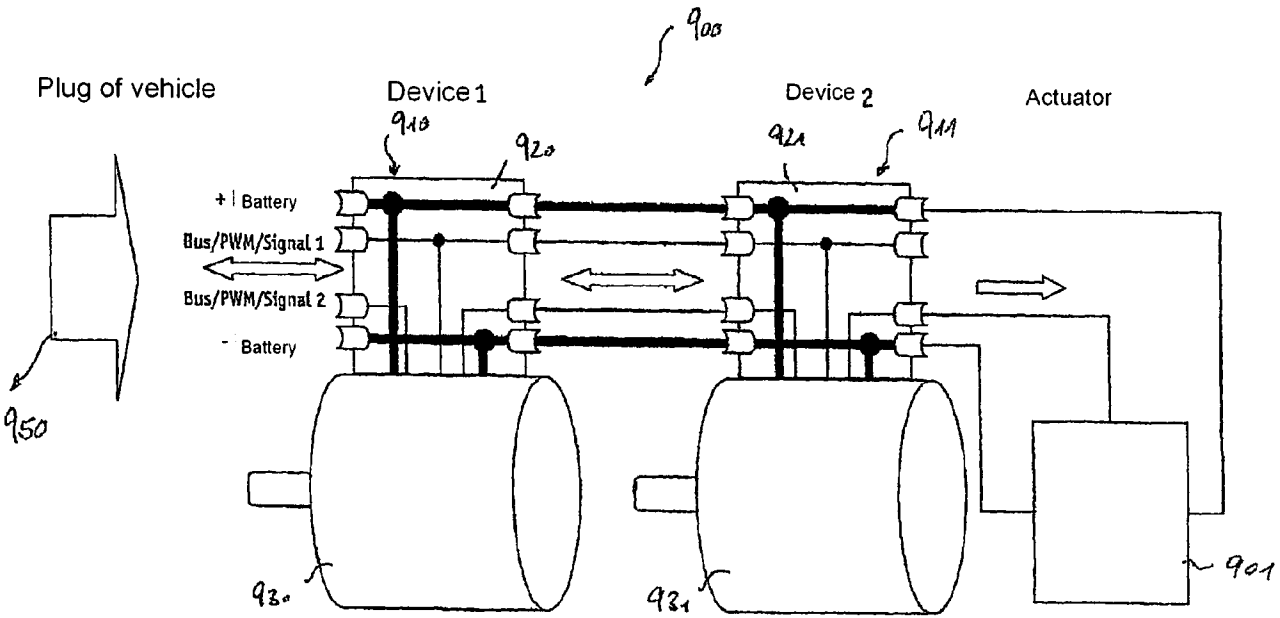
FIG. 9 shows a drawing of a sample switching diagram in a double-fan system having a connected actuator, having plug connections contactable at two sides, according to a sixth exemplary embodiment of the present invention.

FIG. 9 shows a drawing of sample switching diagram 900 for the multiple-fan system having the connected actuator, with a two-sided contactable plug connections 910 and 911, electric drives 930 and 931 connected to an electrical system 950 of a motor vehicle using the two-sided contactable plug connections 910 and 911, or two-sided contactable plugs (double plugs) 920 and 921.

The wiring of the two drives, or fan drives, 930 and 931 corresponds to a combination of the wiring patterns of the drives in the multiple-fan system according to FIG. 4 and FIG. 5.

In place of an additional drive, in this double-fan system with a connected actuator, an actuator 901 is connected to second drive 931 by means of double plug connector 911, as shown.

Without limitation of generality, here it is to be noted that the two-sided contactable plug connections in the third to sixth exemplary embodiments can each be realized both, in the realization according to the first exemplary embodiment, as two-sided contactable straight plug connections and also, according to the second exemplary embodiment, as two-sided contactable bent-off plug connections.

It is also expressly noted here that the same holds corresponding to the first and the second exemplary embodiment with reference to the sample switching diagrams according to the third to sixth exemplary embodiments.

The two-sided contactable straight and bent-off plug connections according to the first and the second exemplary embodiments can be wired both according to the sample switching diagram according to exemplary embodiments 3 and 4 and also according to the sample switching diagram according to exemplary embodiments 5 and 6.

The invention claimed is:

1. A device for connecting a plurality of electric drives to at least one supply network of a motor vehicle, comprising:

a first contact unit to which at least one first line of the at least one supply network is connectable;

a second contact unit to which a first electric drive is connectable;

the first contact unit being connected to the second contact unit such that a line connection is created between the at least one supply network and the first electric drive;

a third contact unit to which at least one second line is connectable, wherein the at least one second line is connected to an additional electric drive;

the third contact unit being connected to the first contact unit or to the second contact unit in such a way that a direct or indirect line connection is created between the at least one second line and the at least one supply network;

at least one metallic flat conductor including, at a first end thereof, a first longitudinal segment having a first free end and a second longitudinal segment having a second free end, the first contact unit being provided at the first free end of the first end of the metallic flat conductor, and the third contact unit being provided at the second free end of the first end of the metallic flat conductor; and the second contact unit being provided at a second end of the metallic flat conductor, the second contact unit being integrated into the first electric drive.

2. The device as recited in claim 1, wherein at least one of a plurality of first lines is connectable to the first contact unit and a plurality of second lines is connectable to the third contact unit.

3. The device as recited in claim 1, wherein at least one of the at least one first and the at least one second line is a power supply line or a communication line.

4. The device as recited in claim 1, wherein the at least one supply network is a power supply network or a communication network, in particular a bus system or a control network.

5. The device as recited in claim 1, wherein at least one of the first, second, and third contact units has at least one plug contact.

6. The device as recited in claim 1, wherein at least one of the first, second, and third contact units is set up to accept a contact plug.

7. The device as recited in claim 1, wherein at least one of the first electric drive and the additional electric drive is an electric motor, in particular an electric motor of an electric fan.

8. The device as recited in claim 1, wherein the device is used for at least one of cooling and air conditioning, in particular of a passenger compartment of the motor vehicle or an engine of the motor vehicle, at least one of the first electric drive and the additional electric drive being an electric motor of an electric fan or air-conditioning blower.

9. The device as recited in claim 1, wherein the device is a multipolar, in particular a two-pole, three-pole, or four-pole, plug system, in particular a multipolar double plug.

10. A method for manufacturing a device for connecting a plurality of electric drives to at least one supply network of a motor vehicle, comprising:

dividing a metallic flat conductor along a predeterminable dividing line in a predeterminable area at a first end of the metallic flat conductor, a first longitudinal segment of the metallic flat conductor being formed having a first free end and a second longitudinal segment of the metallic flat conductor being formed having a second free end;

at the first free end of the first end of the metallic flat conductor a first contact unit is provided to which at least one first line of the at least one supply network is connectable, and at the second free end of the first end of the metallic flat conductor a third contact unit is provided to which at least one second line is connectable wherein the at least one second line is connected to an additional electric drive;

at a second end of the metallic flat conductor, a second contact unit is provided, the second contact unit being integrated into a first electric drive;

the first contact unit being connected to the second contact unit so that a line connection is created between the at least one supply network and the first electric drive; and the third contact unit being connected to the first contact unit or to the second contact unit so that a direct or indirect line connection is created between the at least one second line and the at least one supply network.

11. The method as recited in claim 10, wherein the metallic flat conductor is extrusion-coated, in particular with a plastic.

12. The method as recited in claim 10, wherein the metallic flat conductor is made of a metal based on copper.

13. The method as recited in claim 12, wherein at least one of the first and the second longitudinal segment is bent.

14. The method as recited in claim 12, wherein the metallic flat conductor is extrusion-coated, in particular with a plastic.

15. The method as recited in claim 10, wherein at least one of the first and the second longitudinal segment is bent.

16. The method as recited in claim 15, wherein the metallic flat conductor is extrusion-coated, in particular with a plastic.

* * * * *